US008038314B2

(12) United States Patent
Ladewig

(10) Patent No.: US 8,038,314 B2
(45) Date of Patent: Oct. 18, 2011

(54) LIGHT EMITTING DIODE TROFFER

(75) Inventor: Christopher Ladewig, Fayetteville, GA (US)

(73) Assignee: Cooper Technologies Company, Houston, TX (US)

( * ) Notice: Subject to any disclaimer, the term of this patent is extended or adjusted under 35 U.S.C. 154(b) by 306 days.

(21) Appl. No.: 12/356,879

(22) Filed: Jan. 21, 2009

(65) Prior Publication Data

US 2010/0182782 A1 Jul. 22, 2010

(51) Int. Cl.
*F21V 21/00* (2006.01)

(52) U.S. Cl. ..... 362/217.12; 362/219; 362/217.16

(58) Field of Classification Search ..... 362/218–225, 362/217.01–217.17, 396
See application file for complete search history.

(56) References Cited

U.S. PATENT DOCUMENTS

| | | | | |
|---|---|---|---|---|
| 1,761,868 | A | 6/1930 | Burke | |
| 2,560,729 | A * | 7/1951 | Lynn et al. | 56/15.3 |
| 3,030,497 | A | 4/1962 | Cheng | |
| 4,136,474 | A | 1/1979 | Belokin | |
| 4,525,391 | A | 6/1985 | Eckberg | |
| 4,535,391 | A | 8/1985 | Hsiao | |
| 5,025,355 | A | 6/1991 | Harwood | |
| 5,103,382 | A | 4/1992 | Kondo et al. | |
| 5,428,897 | A | 7/1995 | Jordan et al. | |
| 5,479,327 | A * | 12/1995 | Chen | 362/222 |
| 5,913,617 | A | 6/1999 | Helstern | |
| 6,286,586 | B2 | 9/2001 | Cook | |
| 6,295,203 | B1 | 9/2001 | Lo | |
| 6,299,327 | B1 * | 10/2001 | Camarota | 362/219 |
| 6,361,186 | B1 * | 3/2002 | Slayden | 362/241 |
| 6,415,853 | B1 | 7/2002 | Tao et al. | |
| 6,606,808 | B2 | 8/2003 | Katz | |
| 6,644,387 | B1 | 11/2003 | Lee et al. | |
| 6,813,155 | B2 | 11/2004 | Lo | |
| 6,841,804 | B1 | 1/2005 | Chen et al. | |
| 7,090,375 | B2 * | 8/2006 | Kuisma | 362/225 |
| 7,121,684 | B2 | 10/2006 | Barozzini et al. | |
| 7,157,694 | B2 | 1/2007 | May et al. | |
| 7,175,313 | B2 | 2/2007 | Bednara et al. | |
| D551,795 | S | 9/2007 | Compton et al. | |
| 7,286,296 | B2 | 10/2007 | Chaves et al. | |
| 7,336,492 | B2 | 2/2008 | Yu | |
| 7,374,310 | B2 | 5/2008 | Barozzini et al. | |
| 7,591,578 | B2 * | 9/2009 | Chang | 362/612 |

(Continued)

OTHER PUBLICATIONS www.aavidthermalloy.com/products/maxclip/index.shtml; Feb. 12, 2009.

*Primary Examiner* — Julie Shallenberger
(74) *Attorney, Agent, or Firm* — King & Spalding LLP

(57) ABSTRACT

A troffer-style luminaire includes first and second side ends and a top end extending between the side ends. The side and top ends define an interior region. Light emitting diodes ("LEDs") are coupled along interior surfaces of the side ends, within the interior region. At least some of the LEDs are coupled to the interior surfaces by being wedged between members protruding into the interior region from the interior or other surfaces. In addition, or in the alternative, one or more spring clips can apply a force that holds the LEDs against the interior surfaces. A reflector extends between the LEDs and the top member and reflects light from the LEDs towards a bottom end of the frame. The light emitted by the LEDs is directed to the reflector and then indirectly emitted through the bottom end, into a desired environment.

20 Claims, 2 Drawing Sheets

U.S. PATENT DOCUMENTS

| | | | | |
|---|---|---|---|---|
| 2004/0080938 | A1 | 4/2004 | Holman et al. | |
| 2005/0157500 | A1 * | 7/2005 | Chen et al. | 362/294 |
| 2005/0265019 | A1 * | 12/2005 | Sommers et al. | 362/217 |
| 2007/0206384 | A1 | 9/2007 | Compton et al. | |
| 2007/0217216 | A1 | 9/2007 | Goto et al. | |
| 2008/0037239 | A1 | 2/2008 | Thomas et al. | |
| 2009/0225549 | A1 | 9/2009 | Patrick et al. | |
| 2009/0310330 | A1 | 12/2009 | Vann et al. | |
| 2009/0310361 | A1 | 12/2009 | Patrick et al. | |
| 2009/0321598 | A1 | 12/2009 | Vann | |

* cited by examiner

LIGHT EMITTING DIODE TROFFER

TECHNICAL FIELD

The invention relates generally to troffer-style luminaires ("troffers") and more particularly, to a troffer that uses indirect light from light emitting diodes to output light with low glare and good cutoff.

BACKGROUND

A luminaire is a system for producing, controlling, and/or distributing light for illumination. For example, a luminaire can include a system that outputs or distributes light into an environment, thereby allowing certain items in that environment to be visible. Luminaires are often referred to as "light fixtures".

A troffer is a light fixture that includes a relatively shallow, inverted trough-shaped housing (or "trough") within which at least one light source is disposed. The trough includes a substantially closed top end and a bottom end with an opening through which light from the light source is emitted. Generally, the trough is either suspended from a ceiling or other surface or installed in an opening therein. For example, the trough can be recessed within the ceiling, with the bottom end of the trough being flush with the ceiling. Traditional troffers include fluorescent light sources, with one or more fluorescent lamps extending across a length of each troffer.

Increasingly, lighting manufacturers are being driven to replace fluorescent lamp fixtures with light emitting diode ("LED") fixtures because LEDs tend to have better longevity than fluorescent lamps. Existing LED troffers include multiple LEDs spaced along the length of a top, interior surface of the troffer, with each LED pointing downward, into the environment to be illuminated. Because the LEDs are separate, bright light sources that emit light directly into the environment, the existing LED troffers generally emit light with bright and dark spaced spots onto a surface and poor cutoff. In particular, light emitted by the existing LED troffers tends to result in a substantial amount of glare because the shallow troughs of the LED troffers do not allow the LEDs to be recessed deep enough to achieve good cutoff. Accordingly, a need currently exists in the art for an improved LED troffer with reduced glare, improved cutoff, and more consistent light output.

SUMMARY

The invention provides a troffer that uses indirect light from LEDs to output light with low or no glare and good cutoff. The troffer includes a frame having first and second side ends. A top end of the frame can include top edges of the side ends. The top end also may include one or more top members and/or reflectors extending between the side ends. The frame also can include one or more bottom members extending across at least a portion of a bottom end of the frame. The ends of the frame define an interior region within the frame.

A first plurality of LEDs are coupled along an interior surface of the first side end, within the interior region. The troffer may or may not also include a second plurality of LEDs coupled along an interior surface of the second side end, within the interior region. For example, a troffer that only includes the first plurality of LEDs may emit light in a substantially asymmetric distribution, and a troffer that includes both the first and second pluralities of LEDs may emit light in a substantially symmetric distribution.

At least some of the LEDs can be coupled to their respective interior surface by being wedged between first and second members protruding into the interior region from the interior surface or another surface. In addition, or in the alternative, one or more spring clips can apply a force that presses the LEDs to the interior surfaces. For example, each spring clip can be at least partially disposed around one of the protruding members, with an end of the spring clip pressing an end of a substrate associated with the LEDs against the interior surface. As described in more detail below, pressing the substrates to the interior surfaces allows for transfer of thermal energy from the LEDs to the interior surfaces.

A reflector extends between the LEDs and the top end of the frame and reflects light from the LEDs towards a bottom end of the frame. The reflected, indirect light from the LEDs is emitted through the bottom end, into a desired environment. For example, the reflector can include a single arc-shaped member that extends between the side ends and reflects light from the first plurality of LEDs. Alternatively, the reflector can include two arc-shaped members that extend between the side ends. Each arc-shaped member can be associated with one of the first and second pluralities of LEDs and can reflect light generated therefrom. Because the light generated by the LEDs is indirectly emitted into the environment, via the reflector, the light emitted by the troffer has reduced glare and better cut-off compared to traditional LED troffers that directly emit light from shallowly-recessed LEDs. In certain exemplary embodiments, the bottom members, if any, block light from traveling directly from the LEDs to the environment, providing additional protection from glare as well as enhanced cut-off.

These and other aspects, features and embodiments of the invention will become apparent to a person of ordinary skill in the art upon consideration of the following detailed description of illustrated embodiments exemplifying the best mode for carrying out the invention as presently perceived.

BRIEF DESCRIPTION OF THE DRAWINGS

For a more complete understanding of the present invention and the advantages thereof, reference is now made to the following description, in conjunction with the accompanying figures briefly described as follows.

DETAILED DESCRIPTION OF EXEMPLARY EMBODIMENTS

Figure 1:
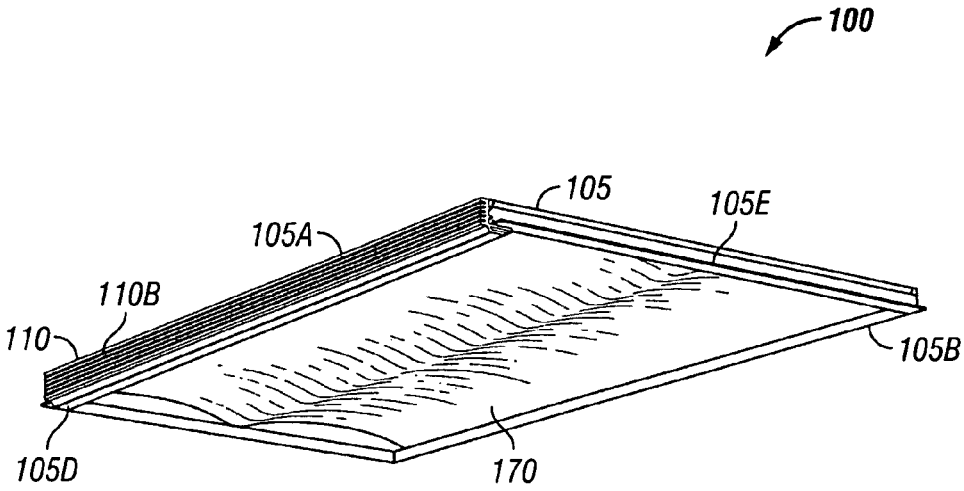
FIG. 1 is a perspective bottom view of a troffer, in accordance with certain exemplary embodiments.

The following description of exemplary embodiments refers to the attached drawings, in which like numerals indicate like elements throughout the figures. FIGS. 1-4 illustrate a troffer 100, according to certain exemplary embodiments. With reference to FIGS. 1-4, the troffer 100 includes a frame 105 having a first side end 105*a*, a second side end 105*b*, and a top end 105*c* extending between the first side end 105*a* and the second side end 105*b*. Third and fourth side ends 105*e* and 105*f* extend between the side ends 105*a* and 105*b*, on opposite sides of the frame 105. In certain exemplary embodiments, each side end 105*a-b* and 105*e-f* extends from the top end 105*c* at a substantially orthogonal angle.

In certain exemplary embodiments, the troffer 100 also includes a pair of bottom members 105*d* extending towards one another, between the first and second side ends 105*a* and 105*b*. Each bottom member 105*d* extends from a respective one of the side ends 105*a* and 105*b*. In certain exemplary embodiments, each bottom member 105*d* extends from its respective side end 105*a*, 105*b* at a substantially orthogonal angle. An aperture 106 extends between the bottom members 105*d*, substantially along an axis thereof.

In certain exemplary embodiments, each bottom member 105*d* is integrally formed with its respective side end 105*a*, 105*b*, and the top end 105*c* is integrally formed with at least one of the side ends 105*a-b* and 105*e-f*. For example, the members 105*d* and/or top end 105*c* can be formed with one or more of the side ends 105*a-b* and 105*e-f* via molding, casting, extrusion, or die-based material processing. Alternatively, at least one of the bottom members 105*d*, the top member 105*c*, and/or the side ends 105*a-b* and 105*e-f* can include a separate component that is separately coupled to at least one of the other components via solder, braze, welds, glue, plug-and-socket connections, epoxy, rivets, clamps, fasteners, or other fastening means. Although the exemplary embodiment is depicted in the figures as having a substantially rectangular-shaped geometry, alternative embodiments of the frame 105 have any of a number of different shapes, including, without limitation, a square shape and a frusto-conical shape. For example, in certain exemplary embodiments, one or more of the side ends 105*a-b* and 105*e-f* can be angled outward or inward relative to the top end 105*c*. In addition, the frame 105 may not include a top member 105*c* in certain alternative exemplary embodiments. In such embodiments, top edges of the side ends 105*a-b* and 105*e-f* can define a top end of the frame 105.

The frame 105 also is capable of being configured in a number of different sizes. In certain exemplary embodiments, the frame 105 is two feet wide by two feet long. In other exemplary embodiments, the frame 105 is two feet wide by four feet long. A person of ordinary skill in the art having the benefit of the present invention will recognize that these sizes are merely exemplary and the frame 105 can have any other size in alternative exemplary embodiments. The frame 105 is configured to be suspended from, or recessed within, a ceiling or other surface (not shown).

Figure 4:
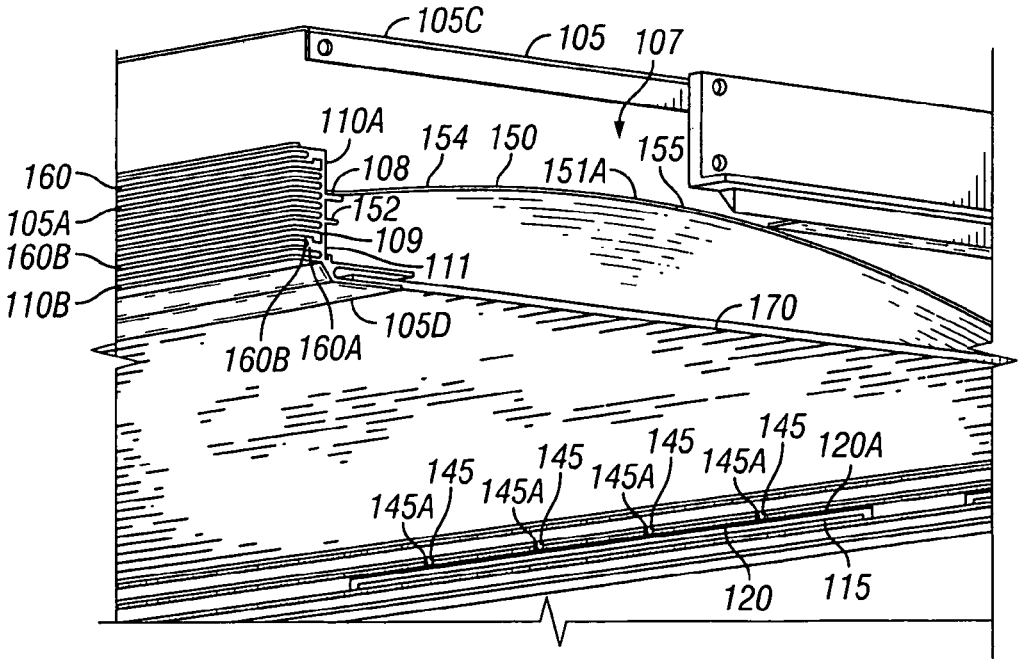
FIG. 4 is a partially exploded side view of the troffer of FIG. 1, in accordance with certain exemplary embodiments.

The side ends 105*a-b* and 105*e-f* together with the top end 105*c* and the bottom members 105*d* define an interior region 107. As best seen in FIG. 4, each side end 105*a*, 105*b* includes a heat sink member 110 that has an interior side 110*a* within the interior region 107 and an exterior side 110*b* disposed opposite the interior side 110*a*, outside of the interior region 107. The interior side 110*a* includes a top platform 108 and a bottom platform 109. Each of the platforms 108 and 109 includes an elongated member that extends substantially perpendicularly or angularly from the interior side 110*a*, into the interior region 107. Each of the platforms 108 extends longitudinally along the length of its respective side end 105*a*, 105*b*. The top platform 108 engages and at least partially supports a reflector 150, as described below. Each bottom platform 109 and a ridge 111 extending angularly from an interior side 105*d* a of the bottom platform's corresponding bottom member 105*d* support a substrate 120 for one or more LEDs 115, as described below.

The substrates 120 and LEDs 115 are thermally coupled to the interior sides 110*a*, along longitudinal axes thereof. More specifically the substrates 120 and LEDs 115 on each interior side 110*a* are disposed substantially along a longitudinal axis of the interior side's corresponding side end 105*a*, 105*b*. In certain exemplary embodiments, some or all of the LEDs 115 on each side 110*a* are mounted nearly end to end on a common substrate 120, substantially in the form of a "strip." Alternatively, groups of one or more of the LEDs 115 can be mounted to their own substrates 120. In certain alternative exemplary embodiments, the troffer 100 can include LEDs 115 disposed only on one of the interior sides 110*a*. In such embodiments, the troffer 100 can emit light in a substantially asymmetric distribution.

Each substrate 120 includes one or more sheets of ceramic, metal, laminate, circuit board, mylar, or another material. Each LED 115 includes a chip of semi-conductive material that is treated to create a positive-negative ("p-n") junction. When the LEDs 115 are electrically coupled to a power source, such as a driver 125, current flows from the positive side to the negative side of each junction, causing charge carriers to release energy in the form of incoherent light.

The wavelength or color of the emitted light depends on the materials used to make each LED 115. For example, a blue or ultraviolet LED typically includes gallium nitride ("GaN") or indium gallium nitride ("InGaN"), a red LED typically includes aluminum gallium arsenide ("AlGaAs"), and a green LED typically includes aluminum gallium phosphide ("AlGaP"). Each of the LEDs 115 is capable of being configured to produce the same or a distinct color of light. In certain exemplary embodiments, the LEDs 115 include one or more white LEDs and one or more non-white LEDs, such as red, yellow, amber, green, or blue LEDs, for adjusting the color temperature output of the light emitted from the troffer 100. A yellow or multi-chromatic phosphor may coat or otherwise be used in a blue or ultraviolet LED to create blue and red-shifted light that essentially matches blackbody radiation. The emitted light approximates or emulates "white," incandescent light to a human observer. In certain exemplary embodiments, the emitted light includes substantially white light that seems slightly blue, green, red, yellow, orange, or some other color or tint. In certain exemplary embodiments, the light emitted from the LEDs 115 has a color temperature between 2500 and 5000 degrees Kelvin.

In certain exemplary embodiments, an optically transmissive or clear material (not shown) encapsulates at least some of the LEDs 115, either individually or collectively. This encapsulating material provides environmental protection while transmitting light from the LEDs 115. For example, the encapsulating material can include a conformal coating, a silicone gel, a cured/curable polymer, an adhesive, or some other material known to a person of ordinary skill in the art having the benefit of the present disclosure. In certain exemplary embodiments, phosphors are coated onto or dispersed in the encapsulating material for creating white light. In certain exemplary embodiments, the white light has a color temperature between 2500 and 5000 degrees Kelvin.

Although illustrated in the figures as being arranged in a substantially rectangular-shaped geometry, a person of ordinary skill in the art having the benefit of the present disclosure will recognize that the LEDs 115 can be arranged in any geometry. For example, in certain alternative exemplary embodiments, the LEDs 115 are configured in circular or square-shaped geometries. The LEDs 115 are coupled to the substrate(s) 120 by one or more solder joints, plugs, screws, glue, epoxy or bonding lines, and/or other means for mounting an electrical/optical device on a surface. Similarly, each substrate 120 is typically coupled to one of the interior sides 110*a* by one or more solder joints, plugs, screws, glue, epoxy or bonding lines, and/or other means for mounting an electrical/optical device on a surface. In certain exemplary embodiments, each substrate 120 is coupled to its corresponding interior side 110*a* by a two-part arctic silver epoxy.

In addition, or in the alternative, one or more spring clips 145 applies pressure to at least a portion of each substrate 120 to couple the substrate(s) 120 to the interior sides 110*a*. Each spring clip 145 is disposed at least partially around one of the bottom platforms 109, with an end 145*a* of each spring clip 145 engaging a first end 120*a* of each substrate(s) 120. Each spring clip 145 applies pressure for holding the substrate 120 up against the interior side 110*a*. A second, opposite end 120*b* of each substrate 120 rests on at least a portion of the ridge 111 proximate the side 110*a*. The ridge 111 and spring clip 145 essentially wedge the substrate 120 against the side 110*a*. In certain exemplary embodiments, the substrate 120 is coupled to the side 110*a* by placing the bottom end 120*b* between the ridge 111 and the side 110*a*, placing the top end 120*a* flush against the side 110*a*, and engaging each spring clip 145 to the bottom platform 109 so that the end 145*a* of the spring clip 145 engages the top end 120*a*. In certain alternative exemplary embodiments, the troffer 100 does not include the ridge 111, and each substrate 120 rests on the interior side 105*d* a of its corresponding bottom member 105*d*.

The LEDs 115 are electrically connected to the driver 125, which supplies electrical power to, and controls operation of, the LEDs 115. For example, one or more wires (not shown) couple opposite ends of each substrate 120 to the driver 125, thereby completing one or more circuits between the driver 125, substrate(s) 120, and LEDs 115. In certain exemplary embodiments, the driver 125 is configured to separately control one or more portions of the LEDs 125 to adjust light color and/or intensity. Although illustrated in the figures as being disposed within the interior region 107, substantially along a center of the top member 105*c*, the driver 125 can be located substantially anywhere else in or remote from the troffer 100, in certain alternative exemplary embodiments.

As a byproduct of converting electricity into light, LEDs 115 generate a substantial amount of heat that raises the operating temperature of the LEDs 115 if allowed to accumulate. This heat can result in efficiency degradation and premature failure of the LEDs 115. Each heat sink member 110 is configured to manage heat output by the LEDs 115. In particular, each heat sink member 110 is configured to conduct heat away from the LEDs 115 by increasing the amount of surface area thermally coupled to the LEDs 115. Each heat sink member 110 is composed of any material configured to conduct and/or convect heat, such as die cast or extruded metal.

As set forth above, the interior side 110*a* of each heat sink member 110 includes a surface to which the LEDs 115 and substrates 120 are thermally coupled. At least one fin 160 extends from the exterior side 110*b* of each heat sink member 110, away from the interior region 107. Each fin 160 includes an elongated member that extends longitudinally at least partially along its respective side end 105*a*, 105*b*. In certain exemplary embodiments, multiple fins 160 extend substantially perpendicular from and longitudinally along, and are spaced laterally apart along, the respective side ends 105*a* and 105*b*, between the top end 105*c* and a corresponding one of the bottom members 105*d*. Although illustrated in the figures as having a substantially rectangular-shaped geometry, each fin 160 is capable of having any of a number of different shapes and configurations. For example, each fin 160 can include a solid or non-solid member having a substantially rectilinear, rounded, or other shape.

Each heat sink member 110 is configured to dissipate heat from the LEDs 115 thermally coupled thereto along a heat-transfer path that extends from the LEDs 115, through the substrate 120, and to the fins 160 via the respective end 105*a*, 105*b* associated with the substrate 120. The fins 160 receive the conducted heat and transfer the conducted heat to the surrounding environment (typically air in the ceiling) via convection. In certain exemplary embodiments, heat from the LEDs 115 and substrate 120 is transferred along a path from the LEDs 115 to the substrate 120, from the substrate 120 to the side 110*a*, from the side 110*a* through the respective side end 105*a*, 105*b* to the first end 160*a* of one or more of the fins 160, from each first end 160*a* to a second end 160*b* of the corresponding fin 160, and from each second end 160*b* to the surrounding environment. Heat also can be transferred by convection directly from the side 110*b* and/or the fins 160 to one or more gaps between the fins 160.

Figure 2:
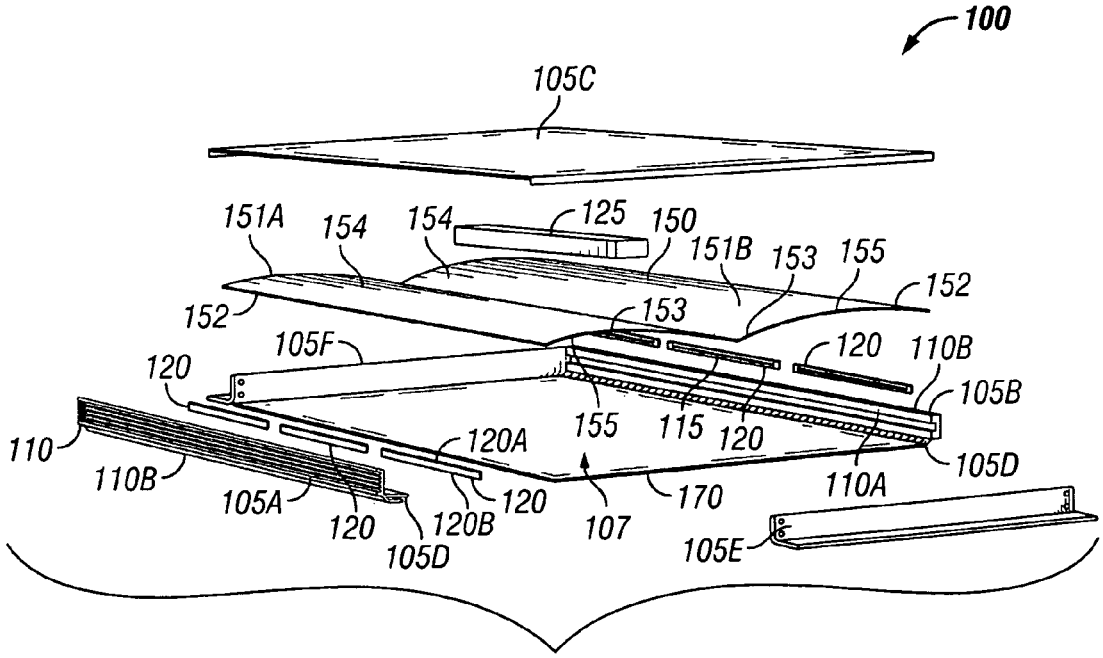
FIG. 2 is an exploded view of the troffer of FIG. 1, in accordance with certain exemplary embodiments.
Figure 3:
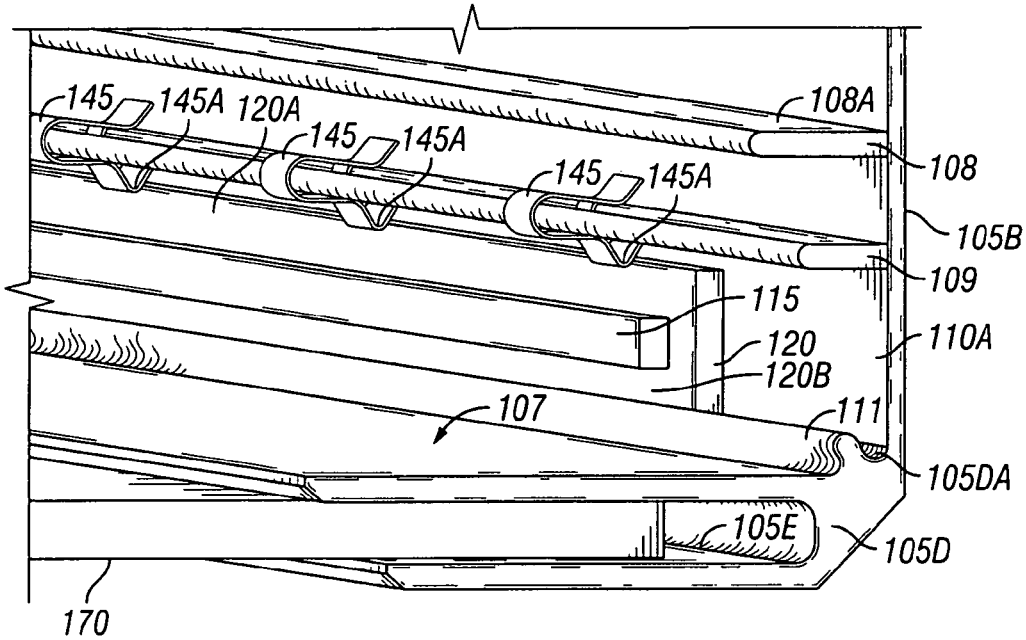
FIG. 3 is a partial perspective view of an interior region of the troffer of FIG. 1, in accordance with certain exemplary embodiments.

As best viewed in FIG. 2, the reflector 150 includes a member with two substantially arc-shaped segments 151*a* and 151*b* that converge along a line extending from the center of side end 105*e* to the center of side send 105*f*. Each segment 151 includes a first end 152 that engages a top surface 108*a* of a respective one of the top platforms 108, and a second end 153 that converges with the second end 153 of the other segment 151. The top platforms 108 support at least a portion of the weight of the reflector 150. In certain exemplary embodiments, the first end 152 extends angularly from a main body portion 154 of each segment 151, so that the first end 152 is substantially flush with the top platform 108. Alternatively, the first end 152 extends along the main body portion 154 without the first end 152 being flush with the top platform 108. Each main body portion 154 is substantially convex, extending upward from the first end 152, towards the top member 105*c*, and downward from an apex 155 (of the main body portion 154) proximate the top member 105*c*, towards the second end 153.

Each segment 151 includes a reflective surface formed on one or both sides, or coupled thereto, for reflecting light generated by the LEDs 115 located proximate the first end 152 of the segment 151. In particular, segment 151*a* reflects light generated by the LEDs 115 coupled to the first side end 105*a*, and segment 151*b* reflects light generated by the LEDs 115 coupled to the second side end 105*b*. Alternatively, segment 151*a* can reflect light generated by the LEDs 115 coupled to the second side end 105*b*, and segment 151*b* can reflect light generated by the LEDs 115 coupled to the first side end 105*a*. The reflected light travels downward from the reflector 150, between the bottom members 105*d*. Thus, the troffer 100 indirectly emits light generated by the LEDs 115 into an environment beneath the troffer 100. Because the light generated by the LEDs 115 is indirectly emitted into the environment, via the reflector 150, the light emitted by the troffer 100 has reduced glare and better cut-off compared to traditional LED troffers that directly emit light from shallowly-recessed LEDs. In certain exemplary embodiments, the bottom members 105*d* block light from traveling directly from the LEDs 115 to the environment, providing additional protection from glare as well as enhanced cut-off. In certain alternative exemplary embodiments, one or both of the side ends 105*a* and 105*b*, and/or the LEDs 115 coupled thereto, can be angled relative to the top end 105*c* to help enhance cut-off.

In certain exemplary embodiments, a lens 170 extends between the bottom members 105*d*, filling at least a portion of the aperture 106. The lens 170 includes an optically transmissive or clear, refractive or non-refractive material (not shown) that provides environmental protection for the LEDs 115 and other internal components of the troffer 100 while also transmitting light from the LEDs 115 into the environment. The lens 170 may not be included in certain alternative exemplary embodiments.

Although specific embodiments of the invention have been described above in detail, the description is merely for purposes of illustration. It should be appreciated, therefore, that many aspects of the invention were described above by way of example only and are not intended as required or essential elements of the invention unless explicitly stated otherwise. Various modifications of, and equivalent steps corresponding to, the disclosed aspects of the exemplary embodiments, in addition to those described above, can be made by a person of ordinary skill in the art, having the benefit of this disclosure, without departing from the spirit and scope of the invention defined in the following claims, the scope of which is to be accorded the broadest interpretation so as to encompass such modifications and equivalent structures.

What is claimed is:

1. A light fixture, comprising:

a housing comprising:

a first side member comprising an interior surface and an opposing exterior surface and further comprising:

a first elongated member extending from substantially the entire longitudinal axis of the interior surface into an interior region;

a second elongated member extending from substantially the entire longitudinal axis of the interior surface into the interior region; and an angled member extending up from the first elongated member into the interior region at a point away from the intersection of the first elongated member and the first side member;

a second side member; and the interior region disposed substantially between the first side member and the second side member;

a substrate comprising a first longitudinal side, a second longitudinal side, and a first plurality of light emitting diodes (LEDs), the second longitudinal side disposed against the first elongated member between the angled member and the first side member, and a back side of the substrate disposed against the interior surface between the first elongated member and the second elongated member;

a spring clip releasably coupled to at least a portion of the second elongated member, wherein a portion of the clip engages the first longitudinal side of the substrate;

a reflector extending substantially between the first plurality of LEDs and a top end of the housing and reflecting light generated by the first plurality of LEDs towards a bottom end of the housing.

2. The light fixture of claim 1, further comprising:

a second plurality of LEDs coupled along an interior surface of the second side member, within the interior region, wherein the reflector extends substantially between the top end of the housing and the first and second pluralities of LEDs, and wherein substantially all of the light emitted from the first and second pluralities of LEDs is reflected by the reflector before exiting the fixture along the bottom end.

3. The light fixture of claim 1, further comprising:

a third elongated member extending angularly from an interior surface of the second side member, into the interior region, each of the second and third elongated members engaging and at least partially supporting an end of the reflector.

4. The light fixture of claim 1, wherein the reflector comprises two substantially arc-shaped segments.

5. The light fixture of claim 4, further comprising:

a third elongated member extending from the interior surface of the second side member; and wherein each arc-shaped segment comprises an end that rests on a respective one of the second and third elongated members.

6. The light fixture of claim 1, wherein the first side member comprises at least one elongated member extending angularly away from the interior region, each elongated member dispersing heat from the first plurality of LEDs.

7. The light fixture of claim 6, wherein each elongated member extends substantially along a longitudinal axis of the first side member.

8. The light fixture of claim 6, wherein the second side member comprises at least one elongated member extending angularly away from the interior region, each elongated member of the second side member dispersing heat from a second plurality of LEDs disposed against the second side member.

9. The light fixture of claim 1, wherein the first side member comprises a plurality of elongated members extending angularly away from the interior region, each elongated member extending substantially along a longitudinal axis of the first side member, at least one gap extending between neighboring ones of the elongated members, each gap extending substantially along the longitudinal axis of the first side member.

10. The light fixture of claim 1, further comprising at least one spring clip releasably coupled to the second side member, the at least one spring clip applying a force to hold at least a portion of at least one of the first plurality of LEDs against the interior surface of the second side member.

11. The light fixture of claim 1, wherein an end of the clip engages the first longitudinal side of the substrate.

12. The light fixture of claim 1, wherein the clip applies a force against the substrate to hold the substrate against the interior surface of the first side member.

13. The light fixture of claim 1, wherein the substrate is substantially wedged between the first side member and the angled member.

14. The light fixture of claim 1, further comprising a cover extending at least partially along the bottom end of the housing, between the first side member and the second side member.

15. The light fixture of claim 14, wherein the cover comprises a lens.

16. The light fixture of claim 1, wherein the first plurality of LEDs emit light having a color temperature between about 2500 degrees Kelvin and about 5000 degrees Kelvin.

17. The light fixture of claim 1, wherein the first plurality of LEDs comprise at least one white LED and at least one non-white LED.

18. The light fixture of claim 1, wherein the light fixture is a troffer.

19. The light fixture of claim 1, further comprising a bottom member extending from the first side member, along the bottom end, wherein the first plurality of LEDs are not visible to a person positioned directly below the bottom member.

20. A light fixture, comprising:

a housing comprising:

a first side member comprising an interior surface and an opposing exterior surface and further comprising:

a first elongated member extending from substantially the entire longitudinal axis of the interior surface into an interior region;

a second elongated member extending from substantially the entire longitudinal axis of the interior surface into the interior region; and a plurality of longitudinally extending heat sink fins extending angularly out from the exterior surface;

a second side member comprising an inner surface and an opposing outer surface and further comprising:

a third elongated member extending from substantially the entire longitudinal axis of the inner surface into the interior region;

a fourth elongated member extending from substantially the entire longitudinal axis of the inner surface into the interior region; and a second plurality of longitudinally extending heat sink fins extending angularly out from the outer surface; and the interior region disposed substantially between the first side member and the second side member;

a first substrate comprising a first longitudinal side, a second longitudinal side, and a first plurality of light emitting diodes (LEDs), the second longitudinal side disposed against the first elongated member and a back side of the substrate disposed against the interior surface between the first elongated member and the second elongated member;

a second substrate comprising a third longitudinal side, a fourth longitudinal side, and a second plurality of LEDs, the fourth longitudinal side disposed against the third elongated member and a back side of the second substrate disposed against the inner surface between the third and fourth elongated members;

a first spring clip releasably coupled to a portion of the second elongated member, wherein the clip contacts the substrate and applies a force to hold the substrate against the interior surface;

a second spring clip releasably coupled to a portion of the fourth elongated member, wherein the second spring clip contacts the second substrate and holds the second substrate against the inner surface;

a reflector extending substantially between the first plurality of LEDs and a top end of the housing and reflecting light generated by the first plurality of LEDs towards a bottom end of the housing; and wherein substantially all of the light emitted from the first plurality of LEDs is reflected by the reflector before exiting the fixture along the bottom end.

* * * * *